United States Patent [19]

Davis

[11] 4,284,006

[45] Aug. 18, 1981

[54] LINEAR EXPLOSIVE CHARGE WITH CONSTANT DETONATION VELOCITY AND SYNCHRONOUS BOOSTER CHARGES

[75] Inventor: Dallas R. Davis, Tulsa, Okla.

[73] Assignee: Davis Explosive Sources, Inc., Tulsa, Okla.

[21] Appl. No.: 65,894

[22] Filed: Aug. 13, 1979

[51] Int. Cl.[3] ..... C06C 11/00

[52] U.S. Cl. ..... 102/317; 181/116

[58] Field of Search ..... 102/21.6, 22, 23, 24 R; 181/116; 403/185

[56] References Cited

U.S. PATENT DOCUMENTS

| | | | |
|---|---|---|---|
| 2,558,163 | 6/1951 | Wright et al. | 102/24 R |
| 2,755,878 | 7/1956 | Smith | 181/116 |
| 2,992,611 | 7/1961 | Felch | 181/116 X |
| 3,150,590 | 9/1964 | Silverman | 102/21.6 |
| 3,244,099 | 4/1966 | Lang et al. | 102/24 R X |
| 3,289,583 | 12/1966 | Silverman | 181/116 X |
| 3,323,611 | 6/1967 | Blayney | 181/116 X |
| 3,815,501 | 6/1974 | Anderson et al. | 102/24 R |
| 4,139,334 | 2/1979 | Payne et al. | 403/185 X |
| 4,166,417 | 9/1979 | Woodcock et al. | 102/24 R |

FOREIGN PATENT DOCUMENTS

| | | | |
|---|---|---|---|
| 316113 | 3/1934 | Italy | 403/185 |

*Primary Examiner*—Peter A. Nelson

*Attorney, Agent, or Firm*—Daniel Silverman

[57] ABSTRACT

A linear explosive charge with constant detonation velocity comprising, a plurality of separate similar sticks that can be axially coupled into a long linear substantially rigid assembly. Each of the sticks includes a helical winding of linear explosive cord on its outer surface, the ends of the cord are coupled to the ends of the cord on adjacent sticks, so as to carry the detonation of the cord from one stick to the next. Separate booster explosive charge units are coupled into each of the junctions between sticks, to provide additional explosive units which are synchronously detonated by the passage of the cord detonation from stick to stick.

12 Claims, 6 Drawing Figures

LINEAR EXPLOSIVE CHARGE WITH CONSTANT DETONATION VELOCITY AND SYNCHRONOUS BOOSTER CHARGES

BACKGROUND OF THE INVENTION

1. Field of the Invention

This invention relates to seismic geophysical surveying. More particularly it relates to a type of explosive charge known as a linear charge, a constant detonation-velocity charge, or a velocity-matching charge, in which the average velocity of detonation of the charge along its length, is substantially the same over equal increments of length of the charge.

Still more particularly it relates to a multiunit, serially-connected charge, having improved means for detonating from one unit to the next, and including the provision of synchronously detonating booster explosive units, as the detonation wave passes the joints between each of the units.

Still more particularly it relates to an improved type of separate booster explosive charge unit, for insertion at multiple spaced points, into a linear explosive charge.

2. Description of the Prior Art

In seismic geophysical surveying, wherein artificial seismic waves are created by detonating an explosive charge in the earth, and the resulting elastic or seismic waves are received by geophones, or other sensors, variously disposed on the earth's surface, it has become generally recognized that a long continuous explosive charge, or an array of many small point charges properly spaced and timed, such as to match the timing to the advancing of a seismic wave front through the adjacent earth medium, offers substantial advantages. Such elongated charges, or arrays, have directional properties, in that the created seismic waves travel in a preferred direction with maximum strength, and at the same time cause less unwanted disturbances travelling in other than the preferred direction.

In the prior art an example of the constant detonation velocity charge is described in U.S. Pat. No. 3,150,590 of Daniel Silverman. Use of this type of charge has been made in the geophysical industry where its particular advantages of directivity of energy delivery, and higher frequency content of the seismic energy, have proved useful in the solution of particular seismic problems.

However, a number of deficiencies and disadvantages of this particular design have been found, including high cost and high weight. A less expensive version of this design utilized a paper tube, in place of the wood stick. But this had other more serious disadvantages. In particular, the charges lacked capability of submersion in water in the shotholes for long periods. More serious, however, was the occurrence of a great number of misfires; that is, failure to detonate from one explosive unit to the next.

In the use of constant velocity charges, there is a limit to the total weight of explosive that can be used on a charge of a given length. Although a given weight of constant velocity charge, because of its directivity, is equivalent, for seismic recording purposes, to several times that weight of concentrated point charge, sometimes additional explosive weight is needed. This can be provided by inserting (preferably) into each of the junctions between adjacent sticks of the linear charge a separate booster explosive charge unit, which is synchronously detonated by the passage of the detonation wave along the explosive card. These separate booster explosive charge units form an important part of this invention.

BRIEF SUMMARY OF THE INVENTION

It is a primary object of this invention to provide a long, velocity-matching explosive charge, that will withstand longtime submersion in water without deterioration to the point of possible misfires.

It is a further object of this invention to provide a long, velocity-matching explosive charge made of many interconnected serial units that has reduced probability of misfires.

It is still a further object of this invention to provide a long velocity-matching explosive charge, the total charge weight of which can be augmented by the addition of concentrated explosive charges at each of the junctions between serially connected units.

It is a still further object of this invention to provide such concentrated charge units in two parts, a container part, without explosive material, and an explosive part, which is loaded into the container part just prior to insertion into the linear charge and into the shot hole.

These and other objects are realized and the limitations of the prior art are overcome in this invention by providing a velocity-matching charge which comprises a long, linear explosive charge having a plurality of serially connected units, or sticks. Each of the sticks is substantially identical, having the same length, the same coupling units on each end, the same weight per unit length of explosive cord, and the same length of explosive cord, thus providing the same time interval for the detonation wave to progress from one end of the stick to the other.

Each stick is made of plastic tubing, with threaded couplings of molded plastic. A hole is drilled at a selected distance from each end, through the wall of the stick. A selected length of explosive cord is wrapped in a helix, on the outer surface of the stick between the two holes. The turns of the helix are equally spaced, and the spacing is designed, in conjunction with the known velocity of detonation of the explosive cord, to provide a selected velocity of detonation from one end of the charge to the other. The two ends of the helix are inserted, one into each of the holes, to extend axially out of the couplings on each end.

For convenience, the end of the stick having the female coupling is considered the first end, and the cord is detonated at this end. The detonation then proceeds through the helix to the second end, with the male coupling.

A selected length of a thick-walled elastic tube that can be made of foamed rubber or platic, or equivalent, is positioned inside the first end of the stick, with the projecting end of the explosive cord passing axially up through the tube. The inner diameter of the tube is less than twice the outer diameter of the explosive cord. Thus, when the cord projecting from the second end of another stick is inserted into the tube in the process of joining two sticks, the elastic tube is stretched, and it provides compression along its full length, forcing the two ends of explosive cord into side-by-side intimate contact. This pressurized contact facilitates cross-detonation between the cords, and so prevents misfires.

Separate explosive charge units are provided, which are constructed as slender elongated containers, with appropriate female and male connectors at the first and second ends, respectively, of the unit. These connectors are identical to those on the separate sticks, and a container can be inserted in each of the junctions, or couplings, between consecutive sticks of the linear charge.

The explosive material can be inserted into the containers just prior to the time the unit is inserted into the linear charge, and the linear charge inserted into the shothole.

One embodiment of the invention involves a solid explosive material, of selected composition, which is formed in the shape of a slender cylinder having an axial opening therethrough. Detonation of the explosive material inside the container is by means of the end of the explosive cord extending from the second, or male, coupling of the stick. The explosive cord is inserted into the top of the axial opening in the charge.

A stub length of explosive cord is also inserted up into the bottom end of the axial opening of the explosive charge, so that it projects out of the male coupling of the charge unit, and can be inserted into the female coupling of the next stick.

BRIEF DESCRIPTION OF THE DRAWINGS

These and other objects and advantages of this invention, and a better understanding of the principles and details of the invention, will be evident from the following description, taken in conjunction with the appended drawing, in which.

DESCRIPTION OF THE PREFERRED EMBODIMENT

Figure 1:
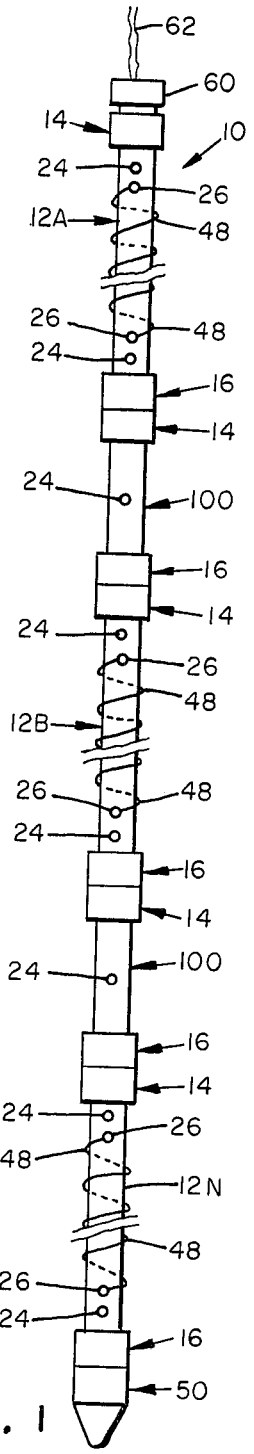
FIG. 1 illustrates a view of the complete explosive assembly of this invention.

Referring now to the drawings and in particular to FIG. 1, there is schematically illustrated one embodiment of this invention, indicated generally by the numeral 10. This explosive assembly is a long, linear assembly of a plurality of separate explosive units, or sticks, indicated by the numeral 12. These separate units 12A, 12B . . . 12N, are all identical and each includes a female coupling element 14 at a first, or detonating end, and a male coupling element 16 at the second end.

At the detonating end of the assembly is a detonator element 60 coupled to the first stick 12A, into which a conventional electrical detonating cap can be inserted, attached to the cap leads 62, as is well known in the art. At the bottom end of the assembly, on the bottom end of the last explosive unit 12N, the open interior of the sticks is closed off with a "point" 50. This prevents the jamming of mud and dirt into the interior of the explosive units, and guides the assembly as it is lowered into the shotholes.

The main structure of the separate sticks comprises a long tube of thin-walled rigid construction. In order to reduce flotation, holes 24 are drilled near each end, through the wall, to permit the flow of water into and out of the interior space.

Figure 2:
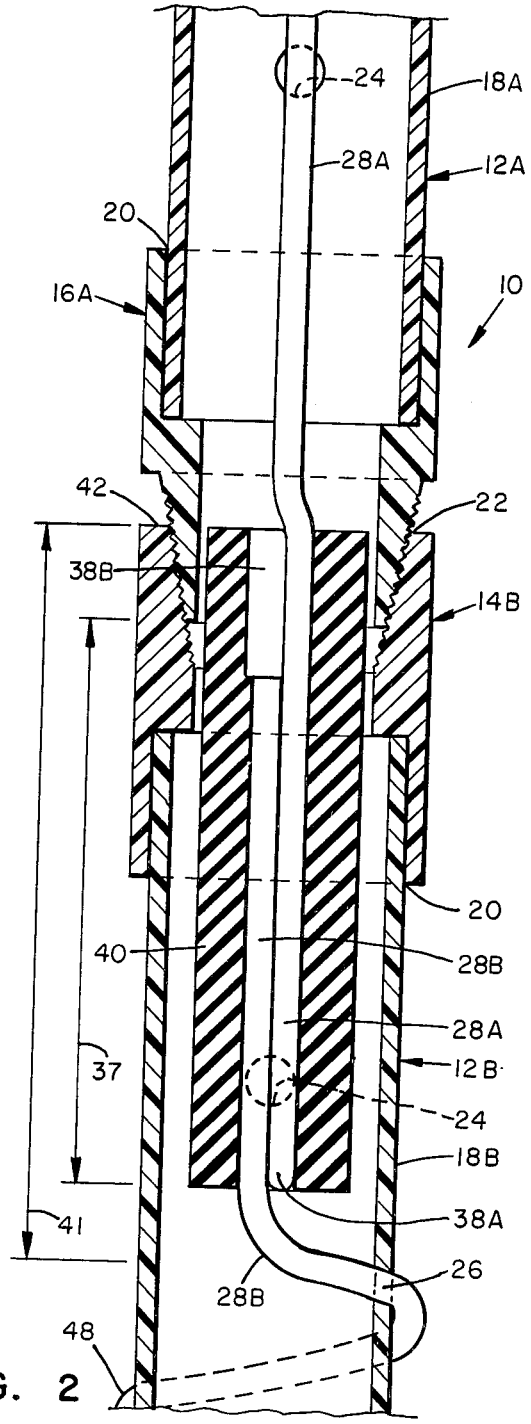
FIG. 2 illustrates in cross-section a view of the lower portion of one stick, coupled to the upper portion of a second stick.

Referring now to FIG. 2, there is shown the coupling between two explosive units or sticks 12A, 12B. The lower end of stick 12A is coupled to the top of a second stick 12B. The stick 12A comprises a plastic tube 18A, to the lower end of which is cemented 20 a male coupling 16A. The top of the second stick 12B comprises the plastic tube 18B to the top end of which is cemented 20 a female coupling 14B. Of course the top end of stick 12A (not shown) will have a female coupling 14A, like 14B; and correspondingly, the bottom end of stick 12B (not shown) will have a male coupling 16B, like 16A, and so on.

At a selected distance from the end of the female coupling 14B is an opening 26 through the wall of the tubing 18B. A similar opening is present at a selected distance from the end of the male coupling 16. In between the two openings 26 is a helix 48 of explosive cord, such as the commercial cord known as Prima Cord, manufactured by the Ensign Bickford Co. of Simsburg, Connecticut 06070. This cord is manufactured in several sizes, including different selected weights of explosive material per unit length of cord. Since the name Prima Cord is well known in the industry, in describing this invention, the cord will be called: explosive cord, prima cord, or simply, cord.

As the cord 48 is wound around the outer surface of the stick, it is held in place by an adhesive tape, not shown. The upper end of the cord is inserted through the opening 26 positioned at a selected distance 41 from the end of the stick, into the interior of the tube, and as 28B projects axially out through the center of the coupling 14B. The cord end is cut to a selected length, and the end is sealed against moisture by placing a brass cap 38B over the end and crimping it in place.

At the bottom end of the stick, the end of the cord 48 is inserted through the opening 26 (not shown) and down through the male coupling, similar to the cord 28A passing down through the coupling 16A. The end of this cord 28A is cut to a selected length 37, and the exposed end is covered with a brass cap 38A which is crimped in place.

Numeral 40 indicates a selected length of thick-walled elastic tube, made of foamed rubber or plastic. The outer diameter is such as to slip easily into the open end of the stick, through the female coupling 14B. The inner diameter is larger than the outer diameter of the cord 28, but is less than twice the diameter of the cord 28. Thus when two ends of the cord, one 28B proceeding upward from inside the stick, and the other one 28A inserted into the top of the tube, and pressed down, the tube will stretch and tightly bind the two cords together.

The tube 40 is inserted into the top of the stick, surrounding the upwardly extending end of cord 28B. The length of the tube is less than the distance 41 from the opening 26 to the end of the female coupling.

When two sticks are to be coupled, the bottom end 16A of the upper stick (in the direction of the detonator 60), which has the extended end 28A of the cord, is positioned coaxially with the second stick 12B. The sealed end 38A of the cord is inserted into the upper end of the tube 40, and is pressed down, until the male coupling 16A engages with the female coupling 14B. The upper stick is then rotated to tighten the threads of the coupling. When the joint is made up, that is, when the threads are tight and the two sticks are rigidly attached, the joint will be as pictured in FIG. 2.

After a sufficient number of sticks are joined in this manner, and the charge is positioned in the shothole, the top end of the cord on the top stick is detonated, as will be described in connection with FIG. 3.

The explosive cord detonates at a known, constant, very high velocity of detonation, passing along the cord, out through the top opening 26, then along the helix, back in through the lower opening 26 to the lower end of the cord 28A. Inside of the tube 40, where the two ends of the cord are pressed together, the detonation of one cord cross-detonates the other cord 28B, and the detonation then passes down the second stick to the second coupling. There the detonation transfers to the cord on the third stick, and so on, until each of the serially connected sticks is detonated.

One important part of this invention is the provision of the elastic tube 40, which, when two sticks are coupled, serves to hold the two cords in tight side-by-side alignment, for the full length of the tube 40. This provides greater assurance of cross-detonation, and therefore freedom from misfires.

The detonating cord has a known constant rate of detonation. The cords on each stick are the same length L, so the time of travel of the detonation from one end of the cord to the other is known. Knowing the length of the stick, which is less than the length of cord, and the travel time, the average velocity of the seismic wave generated in the earth can be determined. By winding the helix with more or fewer turns this average velocity of seismic wave generation can be varied over a wide range, to match in any selected manner, the velocity of seismic wave propagation in the earth along the length of the charge.

I speak here of an elongated, linear, explosive charge, which is the entire assembly of plural separate coaxially joined explosive sticks. In order to gain a maximum of benefit from this charge, it should be of considerable length, preferably of the order of 75 to 125 feet or more long, with a preferred value of at least 100 feet in length. Considering an average length of stick of 5 feet, this would require a charge constructed of twenty explosive sticks coupled end-to-end.

The total weight of explosive in such a charge is only a pound, or a few pounds, at most. Unfortunately, it is not possible to increase total charge weight by increasing the size of the explosive cord. The principal reason for this is that as the cord size increases, the probability of cross-detonation from one turn to another of the helix, increases. This places a practical limit on the maximum size (or charge weight per unit length) of the cord.

When larger weights of explosive are needed, separate booster explosive charge units are added to the linear charge, inserted, preferably, one into each junction between adjacent sticks. These charge units are detonated in timed sequence by the progressive detonation of the explosive cord. This will be fully explained in connection with FIGS. 5 and 6.

In FIG. 2, the dashed circles 24 are indicative of the vent holes through the wall of the sticks for flow of water from the shothole into the interior of the sticks. This prevents a flotation effect that could cause the charge to rise in the shothole.

Figure 3:
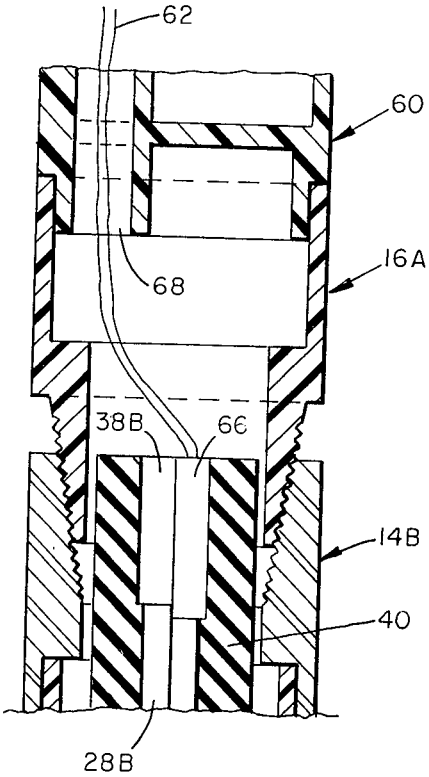
FIG. 3 illustrates the detonating end of the top stick of the explosive assembly of this invention.

Referring now to FIG. 3, there is shown a shield, or detonator unit, indicated generally by the numeral 60. This is fitted and cemented into a male connector 16A and is adapted to be screwed into the top of the uppermost stick of the charge. However, before the unit 60 is attached, an electric detonating cap 66 attached to the firing leads 62 is inserted through the opening 68, and is pressed down inside the elastic tube 40 in side-by-side contact with the upper end 28B of the explosive cord termination 38B. The unit 60 is then screwed down tight, and the leads 62 are made fast around the end of the charge, in a conventional manner. The charge is now primed, ready to be lowered into the shothole and detonated when desired.

Figure 4:
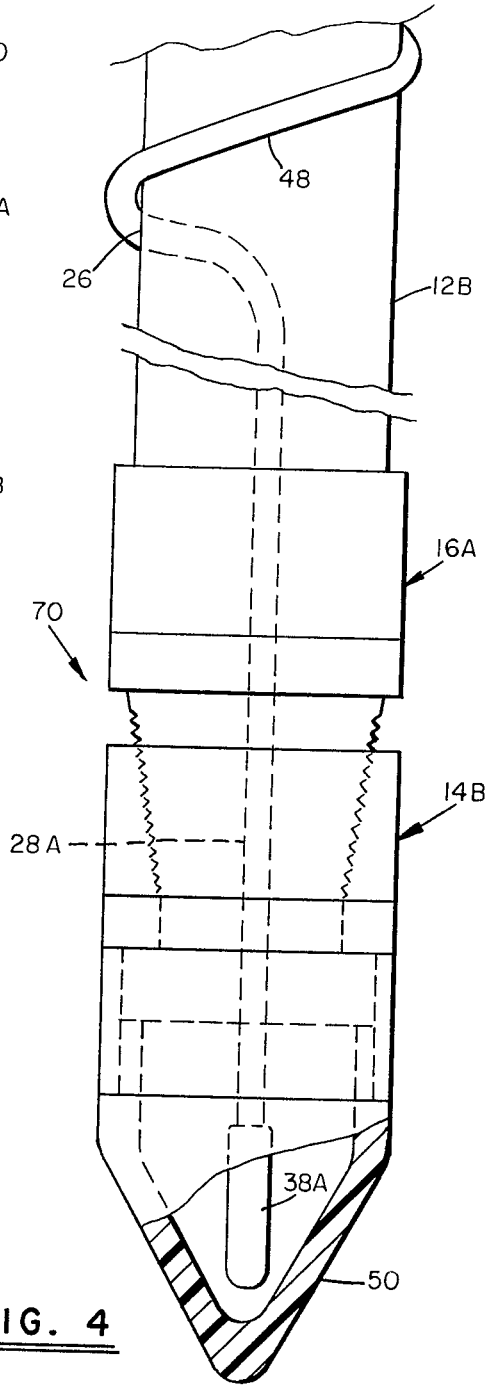
FIG. 4 illustrates the bottom end of the lowermost stick.

Referring now to FIG. 4, there is shown the point termination of the explosive charge, indicated generally by the numeral 70. It is shown attached to the bottom end, male coupling 16A, of the bottommost stick of the charge. This unit 70 is designed to cover the opening in the bottom end of the charge, and to protect the downwardly extending end 38A of the cord 28A. The shield 50 serves to guide the charge as it is lowered into the shothole.

Figure 5:
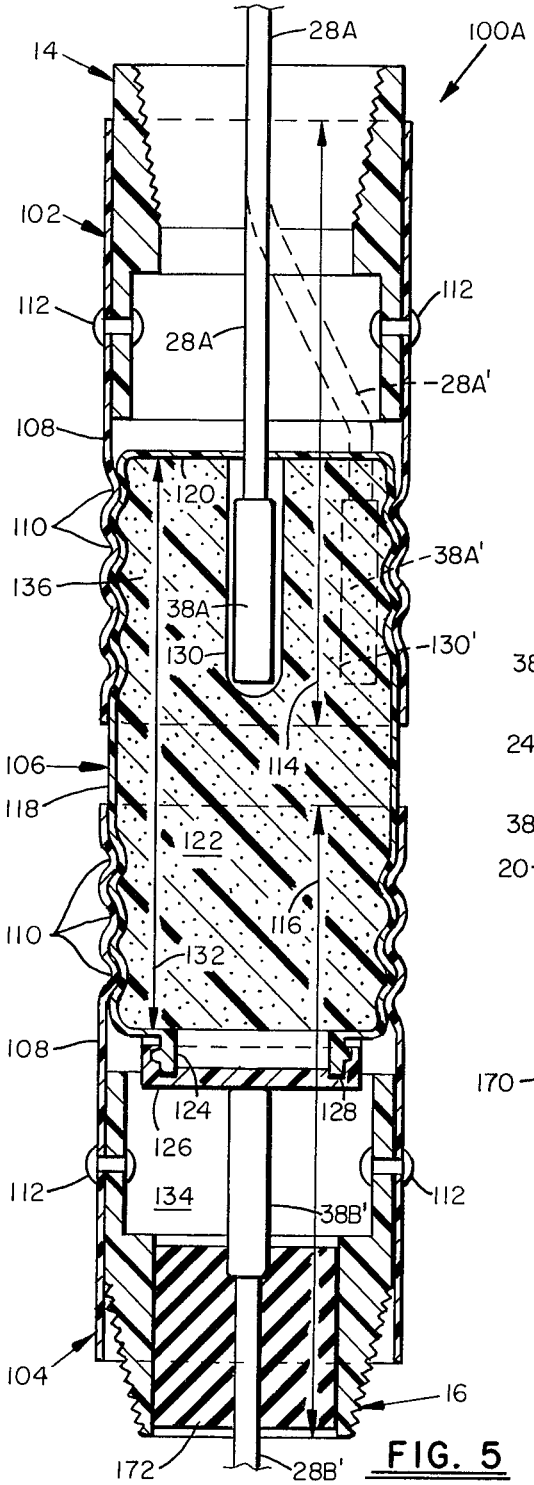
FIG. 5 is a cross-section illustrating one embodiment of the invention in which the container can be loaded with a liquid or slurry-type explosive material.
Figure 6:
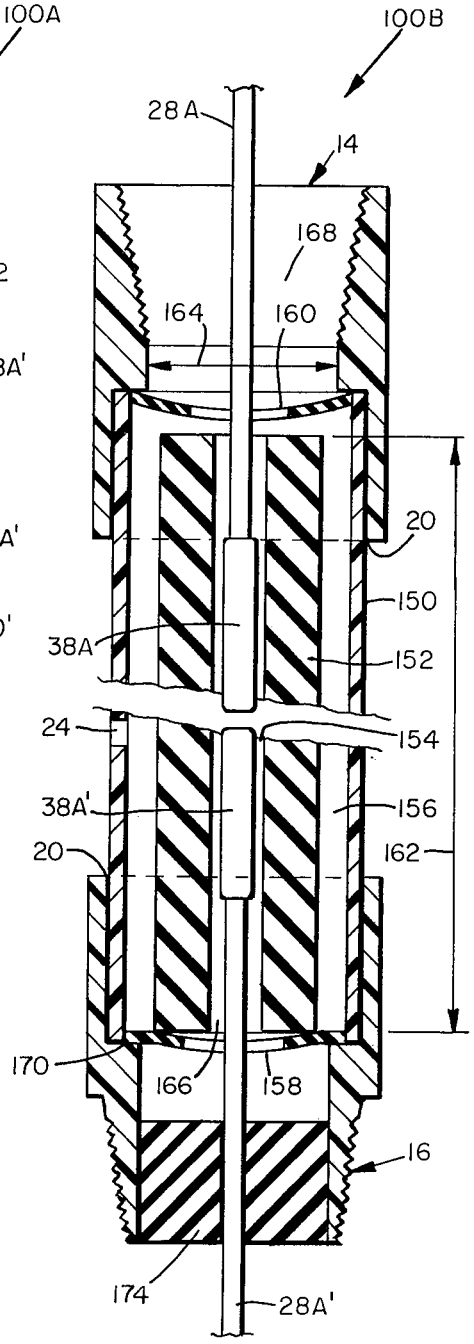
FIG. 6 is a cross-section illustrating a second embodiment in which the explosive material is a solid.

Referring now to FIGS. 5 and 6, there are illustrated two embodiments of a separate type of explosive booster charge, indicated generally by the numerals 100A and 100B. Both of these are slender, cylindrical, rigid units of substantially the same diameter as the sticks 10 of FIG. 2. Each unit is terminated by a polarized coupling identical to those of the sticks 12, a female coupling on the top, or detonating end, and a male coupling on the second end.

Each of the charge units include, as the body of their structure, a container for holding the explosive material. Unit 100A has a liquid-tight container, while unit 100B has a container for solid explosive material. Both of these embodiments are constructed such that the units can be shipped by any transportation system, without explosive material. The explosive material is shipped to the point of use separately, in accordance with laws relating to the shipment of explosives. The explosive material is then inserted into the container at the point of use, prior to the insertion of the charge units into the linear charge, and into the shothole.

Referring now to FIG. 5 and to unit 100A. This unit has a body indicated generally by numeral 106. It comprises a cylindrical bottle molded of suitable plastic material, as would be well known in the art. One end has an opening or mouth 124 covered by a screw cap 126, which is sealed by gasket 128 against the rim of the opening 124.

Both ends of the bottle or container 106 have molded screw threads 110. A similar matching screw thread is molded in a thin-walled plastic tube adapter 108, which can be screwed over the ends of the container. Female 14 and male 16 couplings are provided, identical with those used on the sticks, which are attached, such as by rivets 112 to each of the plastic tubes 108, to permit attachment of the unit 100A into the series of sticks comprising the linear charge.

There is a short trough or channel 130 molded into the wall of the container 106. This is shown in FIG. 5 "face on" and also, as dashed outline 130' in side view. This channel 130 is of such size as to contain the end of the explosive cord 28A projecting out of the male connector of the stick, which will be screwed into the female coupling 14 of the unit 100A. A short stub of explosive cord 28B' with a sealing cap 38B is inserted up into the bottom male connector 16 into the space 134 adjacent the cap 126 of the bottle 106. The stub is held in place by means of a compressed tube of foamed plastic or rubber, or the like. The bottom end of the stub extends from the bottom of the male connector 16 and is inserted into the elastic tube 40 (see FIG. 2) inside of the female connector 14B when the next stick is to be joined to the bottom of the charge unit 100A. Thus, when the charge 136 inside the container 116 is detonated by the cord 28A in the groove 130, the shockwave detonates the stub cord 28B', the detonation then travels down into the tube 40, and cross-detonates the cord 28B of the next stick, and so on.

Referring now to FIG. 6, there is shown in cross-section a second embodiment 100B. This comprises a female coupling 14, and a male coupling 16 cemented 20 to the ends of a short cylindrical tube 150 of selected length, greater than the length 162 of the solid explosive cylinder 152. The explosive is of outer diameter such as to fit through the internal opening 164 of the female coupling. It has an axial opening 166 at least large enough to pass the largest explosive cord wound on the sticks.

A spring washer 158 made of non-metallic material such as sheet plastic is passed through the top opening 168 into the tube 150, where it resumes its flat shape and will rest on the ledge 170 and provide a platform to support the charge cylinder 152. After a charge unit 152 is inserted through opening 168, a second spring washer 160 is placed on top of the charge. Thus the two washers 158, 160 lock the charge 152 into the space 156 inside the tube 150.

When the explosive stick such as 18A of FIG. 2 is coupled into the female coupling 14 of the charge unit, the projecting explosive cord 28A is inserted into the axial opening 166 of the charge 152. Similarly, a short stub of explosive cord 28A' is inserted up into the opening 166 of the charge 152 and is held in position by means of a compressed tube of foamed plastic, or rubber or the like. A portion of the stub cord, similar to 28A, projects out of the bottom end of the male coupling 16, to project into the elastic tube 40 inside the female coupling of the next stick, such as 18B.

Consider that the explosive charge unit 100B as in FIG. 6 is positioned over the male coupling 16A of stick 12A of FIG. 2 and into the female coupling of stick 12B. As the detonation of the explosive cord 28A on the preceding stick 12A progresses, it finally reaches the end 38A, which is inside of the charge unit 152. Here the cord will detonate the charge 152, which in turn will detonate the stub cord 28A'. This detonation will pass down into the elastic sleeve or tube 40, and by proximity, will detonate the explosive cord 28A of the following stick. The detonation of the cord 28B continues down the helix 48 to the next junction, and so on.

To summarize, as the detonation of the explosive cord 28A proceeds down from above, the charge 152 is detonated by the cord 28A, and the shockwave from the detonation detonates the cord 28A', which then proceeds down the cord 28B and the helix 48, and so on.

The long, straight length of cord 28A' from the charge 152 down to the start of the helix 48 at the top opening 26 is very important. The detonation in the cord travels more rapidly than the velocity of the shockwave from the explosive 152. Thus the detonation wave in the cord outraces the shockwave from the charge and continues the detonation to the helix 48, and beyond. By this time, the shockwave is reduced in intensity and velocity and has no opportunity to blow apart the explosive cord 48 (which has already been detonated), which could happen if the shockwave could reach it first.

In a similar manner, the explosive charge 136 inside of the container 106 in the space 122 is detonated by the detonation in the cord 28A lying in the channel 130. The detonation of the charge 136 then detonates the start 38B' of the cord 28B', which, as in the case of FIG. 2, progresses down the cord 28B' to the helix 48 and so on.

While any commercial type of explosive can be used that is suitable for the application in FIGS. 5 and 6, the specific explosive forms no part of this invention. However, I prefer to use as the explosive material 136 in 100A the explosive known as ∓Kinepak" manufactured by Kinepak, Inc., 100 Kinepak Road, Box 1155, Lewisville, Texas 75067. For the solid explosive 152 of unit 100B, I prefer to use "Detaprime", manufactured by E. I. duPont de Nemours Co. (Inc.), Explosive Products Division, Wilmington, DE 19898.

What has been described is a synchronous booster charge unit, which can be added to a linear explosive charge, at each of a number of spaced points along the charge. Each of the booster charge units will be detonated in precisely timed sequence by the detonation of a spiral wrapping of explosive cord. The explosive cord is a safe explosive and is permitted to be carried or shipped with a minimum of precaution. So far as the linear explosive charge is concerned, the explosive cord is added at the factory, and thus is shipped with the mechanical parts of the linear charge.

On the other hand, the booster explosive unit can be shipped from the factory without explosive without any precaution as to the explosive. The booster units are designed in the form of a container, into which the explosive material is inserted just prior to use. Thus, any suitable explosive can be used, provided it is shipped separately to the point of use.

Two embodiments of charge units are disclosed, one of which is adapted for use with solid explosive, and the other for use with a liquid or slurry-type explosive.

While I have illustrated the couplings between each unit as a threaded coupling, this is only by way of example, and any other type of rigid coupling can be used to rigidly fasten the sticks together.

While the invention has been described with a certain degree of particularity, it is manifest that many changes may be made in the details of construction and the arrangement of components. It is understood that the invention is not to be limited to the specific language used or the specific embodiments set forth herein by way of exemplifying the invention, but the invention is to be limited only by the scope of the attached claim or claims, including the full range of equivalency to which each element or step thereof is entitled.

I claim:

1. A linear explosive charge with constant detonation velocity, comprising;

(a) a plurality of series-connected units, or sticks, and means to colinearly join said sticks together in a long linear substantially rigid assembly;

(b) each stick comprising;

(1) a tubular member of selected length and diameter;

(2) a polarized coupling attached at each end, a female coupling at one end, and a male coupling at the other end;

(3) a helical winding of linear explosive cord on the outside surface of said tubular member, near each end of said stick, said explosive cord inserted through an opening in the wall of said stick, with the ends of said cord extending outwardly through said couplings for selected distances;

(4) at the end having the female coupling, a selected length of thick-walled elastic tube inserted over the end of said explosive cord into the end of said stick; the inner diameter of said tube less than twice the diameter of said explosive cord;

whereby when the end of said cord extending from the male end of a first stick is inserted into said elastic tube inside the female coupling of a second stick, as the joint is made up, said elastic tube will expand and press both ends of the explosive cord together in tight side-by-side contact to facilitate the process of cross-detonation from the cord on one stick to the cord on the other stick, and (c) at least one separate booster explosive charge unit, having a female and male coupling on the first and second ends, respectively, identical to those on said sticks;

whereby said booster explosive charge unit can be coupled between a selected pair of sticks; and including (d) means to detonate said booster explosive charge by the detonation of the explosive cord extending from the male coupling of the stick coupled into its female coupling;

(e) from the detonation of said booster charge, means to detonate the explosive cord in the female coupling of the stick coupled to the male coupling of said booster charge.

2. The explosive charge as in claim 1 in which said booster explosive charge unit comprises;

(a) a tubular container, for holding the explosive material in said charge unit, (b) a polarized coupling at each end, identical to those on said stick, a female coupling on a first end, and a male coupling on the second end; and (c) means at the point of use for positioning said explosive material inside said container, and connecting said explosive charge unit in series with two sequential sticks of said linear explosive charge, prior to the time of detonation.

3. The explosive charge unit as in claim 2 in which said container comprises a tubular casing with female and male couplings, said charge is a solid material, cylindrical in shape and adapted to fit inside said tubing casing, and means to lock said charge securely inside said casing.

4. The explosive charge unit as in claim 3 in which said solid cylindrical explosive material has an axial opening therethrough, into which is inserted the explosive cord from the male end of the stick coupled to the female end of said booster charge unit.

5. The explosive charge unit as in claim 4, and including a stub of explosive cord positioned in said axial opening, and extending out through the male coupling on the second end of said charge unit.

6. The booster explosive charge unit as in claim 2, in which said container comprises a plastic bottle having a liquid-tight seal, said female and male couplings attached axially to said bottle; and means to load into said bottle a liquid or granular explosive material, prior to coupling of said bottle in series with two sequential sticks of said linear explosive charge.

7. The explosive charge unit as in claim 6, and including in the wall of said bottle at least one reentrant groove into which the explosive cord can be placed, from the male end of the stick coupled to the female end of said booster charge unit.

8. The explosive charge as in claim 1 in which said polarized couplings comprise threaded couplings.

9. The explosive charge as in claim 1 including a detonator unit coupled into the top coupling of the top stick of the charge.

10. The explosive charge as in claim 1 including a pointed closure unit closing of the bottom end of the bottom stick of said charge.

11. The explosive charge as in claim 1, in which said explosive cord is of the type known as Prima Cord.

12. The explosive charge as in claim 1 in which the spacing between turns of the helix of said explosive cord is a function of the desired detonation velocity of said explosive charge.

* * * * *